US010458118B2

(12) United States Patent
Hattar et al.

(10) Patent No.: US 10,458,118 B2
(45) **Date of Patent: *Oct. 29, 2019**

(54) FIBER RING REINFORCEMENT STRUCTURES

(71) Applicant: HATTAR TANIN LLC, Novato, CA (US)

(72) Inventors: Saadeh Hattar, Novato, CA (US); Volodymyr Tanin, Kiev (UA)

(73) Assignee: Hattar Tanin, LLC, Novato, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/044,436

(22) Filed: Jul. 24, 2018

(65) Prior Publication Data

US 2019/0017272 A1 Jan. 17, 2019

Related U.S. Application Data

(63) Continuation of application No. 15/372,167, filed on Dec. 7, 2016, now Pat. No. 10,030,391.

(60) Provisional application No. 62/263,850, filed on Dec. 7, 2015.

(51) Int. Cl.

| | |
|---|---|
| ***E04C 5/07*** | (2006.01) |
| ***E04C 1/00*** | (2006.01) |
| ***E01C 11/16*** | (2006.01) |
| ***E01C 11/18*** | (2006.01) |
| ***E01C 19/50*** | (2006.01) |

(52) U.S. Cl.

CPC ..... *E04C 5/073* (2013.01); *E01C 11/165* (2013.01); *E01C 11/18* (2013.01); *E01C 19/50* (2013.01); *E04C 1/00* (2013.01); *E01C 2201/167* (2013.01)

(58) Field of Classification Search

CPC . E04C 5/073; E04C 1/00; E01C 19/50; E01C 2201/167

See application file for complete search history.

(56) References Cited

U.S. PATENT DOCUMENTS 1,610,996 A * 12/1926 Bruckshaw ..... E05G 1/024 52/659
1,741,611 A * 12/1929 Bruckshaw ..... E05G 1/024 52/659
1,913,707 A * 6/1933 Etheridge ..... C04B 20/0008 428/221

(Continued)

FOREIGN PATENT DOCUMENTS

DE 102006051083 A1 * 4/2008 ..... E04C 5/073
JP 01153563 A * 6/1989 ..... E04C 5/012
WO WO-2009062764 A1 * 5/2009 ..... B29C 70/885

*Primary Examiner* — Adriana Figueroa
(74) *Attorney, Agent, or Firm* — KW Lap, LLP

(57) ABSTRACT

A method for making a reinforced concrete structure and reinforcement agents are provided. In some embodiments, the method includes obtaining a mold for the reinforced concrete structure. A lattice is formed within the mold, where the lattice includes inter-locking ringed fibers and where each inter-locking ringed fiber is a fiber formed into a ringed structure that is inter-locked with at least one neighboring inter-locking ringed fiber in the lattice. The lattice is then encased by filling the mold with concrete. In some embodiments, the reinforcement agents are a plurality of ringed fiber-structures, each of which is coiled into a ringed structure that may or may not inter-lock with at least one neighboring ringed fiber(s)-structure.

11 Claims, 5 Drawing Sheets

(56) References Cited

U.S. PATENT DOCUMENTS

| | | | | | |
|---|---|---|---|---|---|
| 2,347,449 | A * | 4/1944 | Whitehill | B63B 5/14 | 52/659 |
| 3,616,589 | A * | 11/1971 | Sherard | C04B 20/0008 | 52/659 |
| 3,667,509 | A * | 6/1972 | Rohrbacher | B21F 27/005 | 140/1 |
| 3,913,295 | A * | 10/1975 | Thompson | E04C 5/012 | 52/659 |
| 6,279,858 | B1 * | 8/2001 | Eicher | B21D 11/07 | 245/8 |
| 6,335,087 | B1 * | 1/2002 | Hourahane | D02G 3/447 | 428/293.4 |
| 8,496,396 | B1 * | 7/2013 | Allen | E01C 5/08 | 404/36 |
| 2013/0239503 | A1 * | 9/2013 | Miller | C04B 20/0068 | 52/414 |
| 2014/0060392 | A1 * | 3/2014 | Koenigstein | C04B 20/0068 | 106/802 |

* cited by examiner

FIBER RING REINFORCEMENT STRUCTURES

CROSS REFERENCE TO RELATED APPLICATION

This application is a continuation of U.S. Ser. No. 15/372,167 filed on Dec. 7, 2016, issued as U.S. Pat. No. 10,030,391 on Jul. 24, 2010, which claims priority to U.S. Provisional Patent Application No. 62/263,850, entitled "Ring Fiber Structures Reinforcement Technology," filed Dec. 7, 2015, each of which is hereby incorporated by reference in its entirety for all purposes.

TECHNICAL FIELD

This specification describes methods and ringed structures for reinforcing concrete structures and other building materials.

BACKGROUND

With the world's rapidly growing population, there is increased construction of buildings, roads, and other structures to keep up with increasing infrastructure requirements. As these structures continue to grow in size, the building industry needs new materials with improved strength and stability to meet the physical demands placed on the new structures. For example, new buildings are built higher, roads are constructed in longer and wider stretches. To achieve these demands, architects and contractors are constantly looking for lighter materials with higher strength, as well as for new manufacturing technologies that lower the expense of increasingly larger projects.

SUMMARY

The present disclosure solves these and other problems by providing ringed fiber structures useful as fillers and reinforcement agents for building materials. The disclosure also provides reinforced structures (e.g., concrete structures) containing a lattice of interlocking ringed fibers, as well as method for constructing these reinforced structures (e.g., concrete structures).

Conventional concrete structures are reinforced with rebar. However, concrete only binds to rebar at sites with irregularities on the surface of the rebar. In contrast, the fiber ringed structures described herein provide more interaction sites with the concrete, providing for better reinforcement.

The fiber structures described herein are constructed from one or more types of fibers, which are coiled, reeled, or wound into rings (hereinafter also referred to as ring fiber structures). These ring fiber structures can be used as they are or the fibers in them can be united together with one or more bonding agent. In some embodiments, the fibers used to create the ringed structures are composites of multiple types of fibers, e.g., wrapped or bound together.

In some embodiments, the ring fiber structures include one or both of glass and carbon fibers, bound together with a binding polymer. In other embodiments, the ringed structures descried herein are composed of one or more of carbon fibers, aramid fibers, metal fibers, metal alloy fibers, nylon fibers, and/or any other suitable fiber.

BRIEF DESCRIPTION OF THE DRAWINGS

The implementations disclosed herein are illustrated by way of example, and not by way of limitation, in the figures of the accompanying drawings. Like reference numerals refer to corresponding parts throughout the drawings.

DETAILED DESCRIPTION

Reference will now be made in detail to implementations of the present application as illustrated in the accompanying drawings. The same reference indicators will be used throughout the drawings and the following detailed description to refer to the same or like parts. Those of ordinary skill in the art will realize that the following detailed description of the present application is illustrative only and is not intended to be in any way limiting. Other embodiments of the present application will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as different levels of concrete reinforcement for different types of structures, e.g., roads, bridges, buildings, etc. Moreover, it will be appreciated that such a development effort might be complex and time-consuming, but would nevertheless be a routine undertaking of engineering for those of ordinary skill in the art having the benefit of this disclosure.

Figure 1:
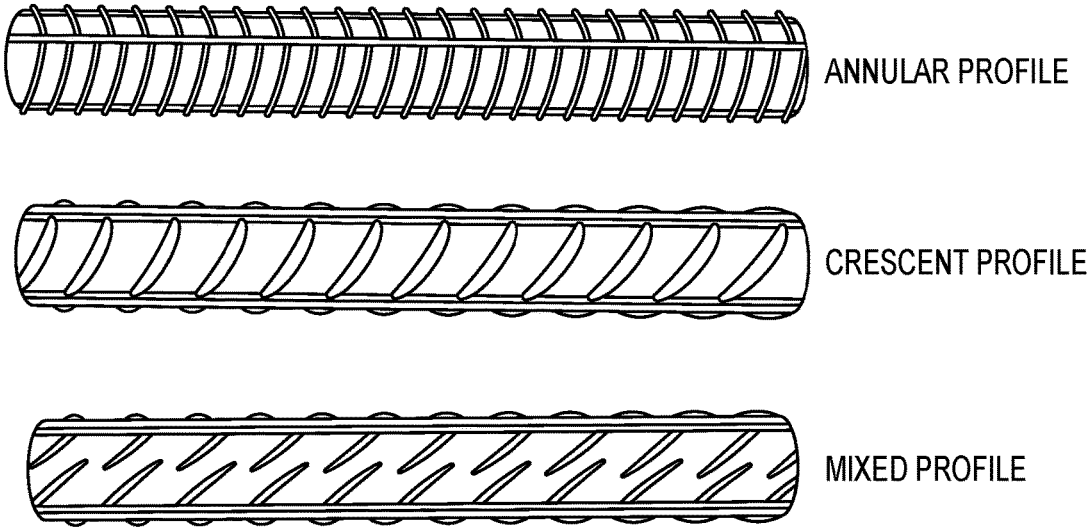
FIG. 1 illustrates three profiles of conventional rebar.
Figure 2:
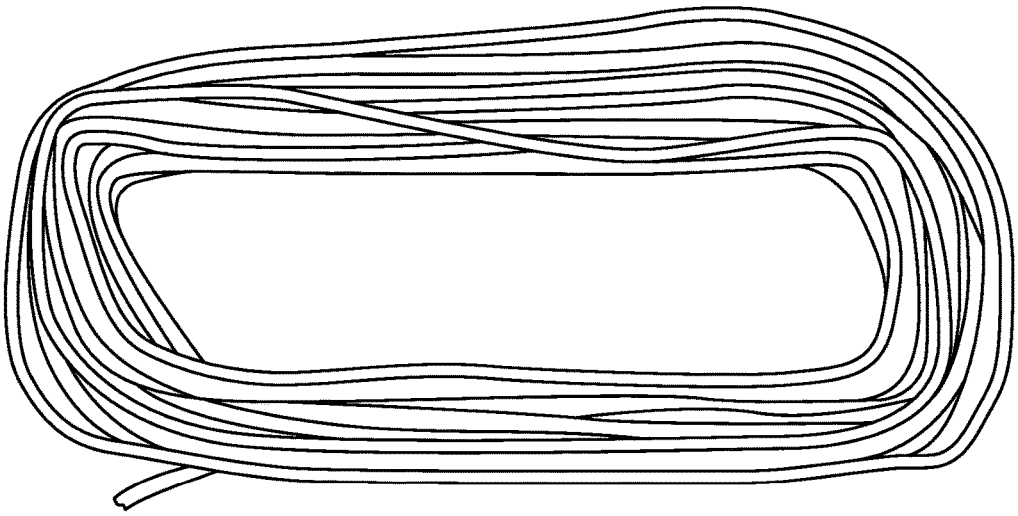
FIG. 2 illustrates an exemplary fiber ring for use as a reinforcing ringed fiber, according to some implementation.
Figure 3:
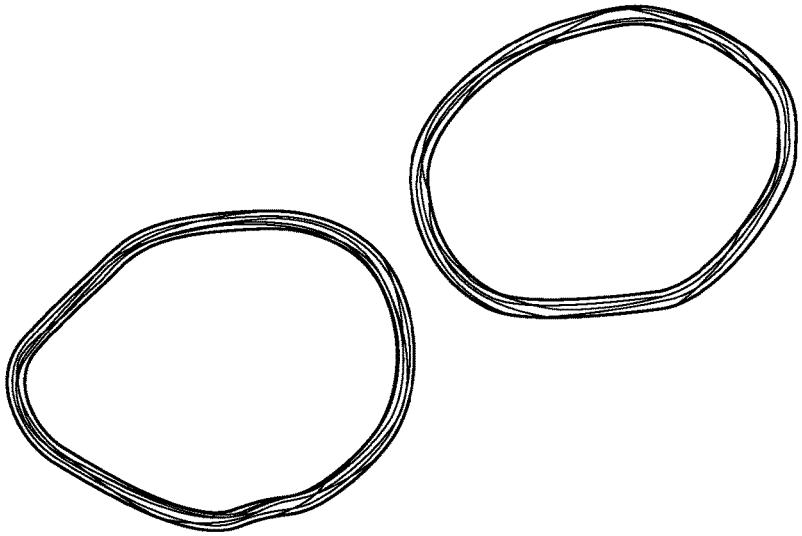
FIG. 3 illustrates another exemplary fiber ring for use as a reinforcing ringed fiber, according to some implementation.

Conventional concrete reinforcement relies upon binding between surface irregularities on various profiles of rebar (e.g., as illustrated in FIG. 1) and concrete. In contrast, the present disclosure provides methods for reinforcing concrete structure using fiber structures, which can be made from one or more types of fibers, that are formed (e.g., coiled, reeled, wound, twisted, etc.) into rings, as illustrated in FIGS. 2 and 3. These ringed fiber structures are fixed in the body of a concrete structure after filling a mold/form containing the ringed fibers with concrete.

The ring fiber structures described herein can be used as they are or fibers in them can be united together with some bonding agent(s) and/or in any other possible way (for example, being wrapped with the same and/or other fiber(s)).

In some embodiments, the ring fibers are made from one or more of a glass fiber or a carbon fiber. In some embodiments, the ring fibers are a composite of glass and carbon fiber, e.g., bound together with a binding polymer. In other embodiments, the ring fibers are made from one or more of a carbon fiber, an aramid fiber, a metal fiber, a metal alloy fiber, a nylon fiber, and/or any other suitable fiber.

Figure 4:
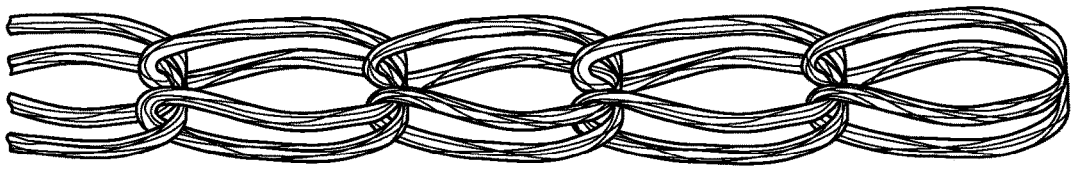
FIG. 4 illustrates an exemplary linear configuration of inter-locking fiber rings for use as a reinforcing agent, according to some implementation.
Figure 5:
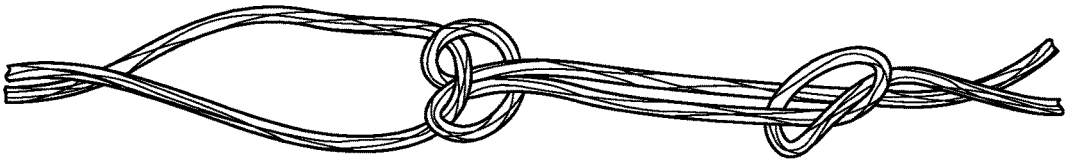
FIG. 5 illustrates another exemplary linear configuration of inter-locking fiber rings for use as a reinforcing agent, according to some implementation.

In some embodiments, the ring fiber structures described herein are inter-linked (or otherwise joined) into a linear chain, as illustrated in FIGS. 4 and 5. The skilled artisan will appreciate that there are many ways to inter-link or otherwise join two or more ringed fiber structures.

Figure 6:
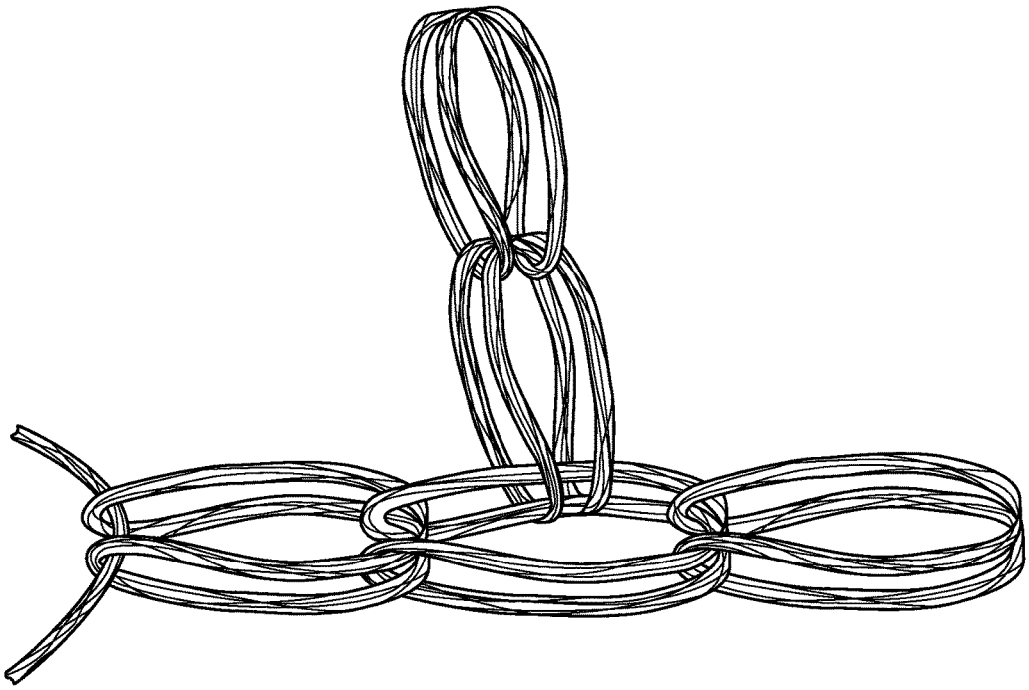
FIG. 6 illustrates an exemplary branched configuration of inter-locking fiber rings for use as a reinforcing agent, according to some implementation.

In some embodiments, the ring fiber structures described herein are inter-linked (or otherwise joined) into a branched chain of ringed fibers, as illustrated in FIG. 6. In some embodiments, branches of multiple chains of fibers can be cross-linked (or otherwise joined) to form a large two-dimensional array of linking fibers (e.g., a lattice of fiber rings joined into a single piece.

Figure 7:
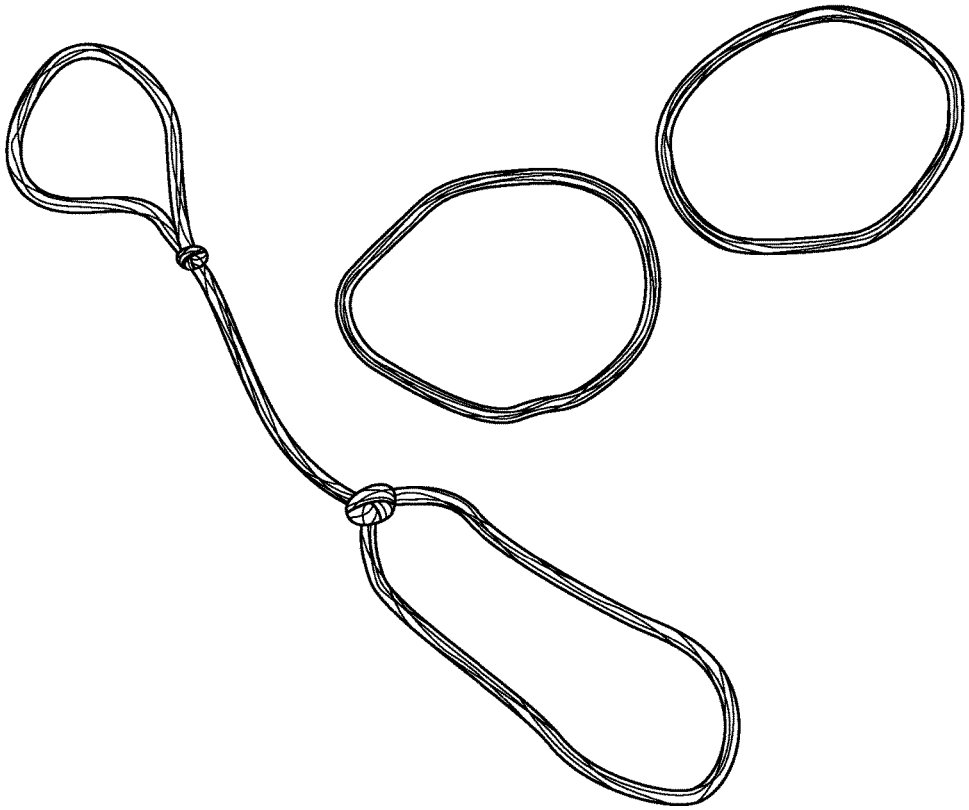
FIG. 7 illustrates that relatively small fiber rings may be joined together to form an inter-locking fiber ring structure for use as a reinforcing agent, according to some implementations.
Figure 8:
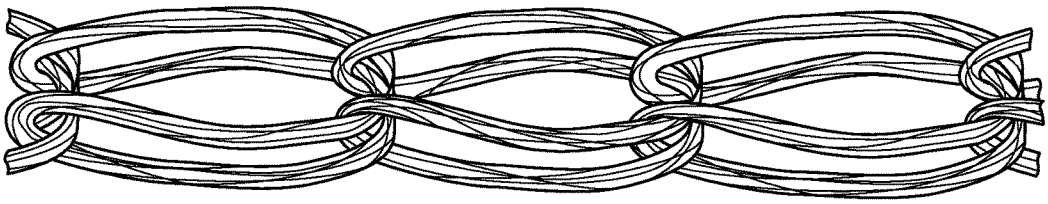
FIG. 8 illustrates another linear configuration of inter-locking fiber rings for use as a reinforcing agent, according to some implementation.

Advantageously, the fiber rings, e.g., as illustrated in FIGS. 7 and 8, can be used as filler material in concrete. For example, in some embodiments, a plurality of single rings (e.g., each with a diameter of about 5-10 cm) is added to the concrete structure (e.g., mixed into wet concrete or placed between layers of concrete). These fiber ringed structures supplement or replace conventional concrete fillers, e.g., cut pieces of fibers (steel, nylon, etc.) which are added to maintain the integrity of the concrete through frictional forces. However, unlike conventional fillers, like fiber pieces, the small ringed fiber structures will be able to keep surrounding volume of hardened concrete. E.g., in order to break a concrete unit it will not be necessary not to pull out separate fiber pieces, but only to break fibers in ringed fiber structures.

In some embodiments, the described ringed-fiber reinforcement system allows implementation of any type fibers instead of conventional reinforcement (rebar).

In some embodiments, the reinforcement methods described herein significantly reduce the weight of the final structure because the inter-locking fiber rings are lighter than rebar, and/or reduce the amount of reinforcement needed because the inter-locking fiber rings are stronger than fixation of conventional rebar in hardened concrete due to increased frictional forces. For example, glass fibers are about 3.2 times lighter from steel fiber and about 3-3.5 times stronger. Further, the fiber rings described herein provide embracing of certain volume of hardened concrete binding with it and binding separate fragments of it, what is differently to rebar, which is fixed inside of hardened concrete only due to surface irregularities.

In some embodiments, the reinforcement methods described herein significantly reduce construction costs because the ring fiber reinforcement structures are significantly lighter than rebar. They can be transported to a construction site in a pre-fabricated state, rather than having to be assembled on-site. In some embodiments, an interlocking fiber ring assembly is wrapped into a coil (e.g., around a spool/bobbin) as a single piece (or in multiple bobbins) and easily uncoiled (and, optionally, connected with other large chains of inter-locked rings, e.g., uncoiled from another spool/bobbin) at the construction site.

In one embodiment, a branched and/or cross-linked interlocking ring fiber structure is pre-assembled with a predetermined width, transported to a construction site (e.g., a road or freeway construction site), and then rolled out (and, optionally, connected to one or more anchoring structures) over a section where concrete will be poured (e.g., a roadway), speeding up the building process.

Ring fiber structures reinforcement technology also has other benefits. In some embodiments, separate fiber rings, and or relatively small units of inter-locking fiber rings, e.g., as illustrated in FIGS. 7 and 8, are used during the reinforcement process as filler for concrete to fix together by embracing the surrounding volume of concrete.

In some embodiments, the ringed fiber structures described herein are used to reinforce asphalt (e.g., bituminous concrete). Asphalt used to build roads is prone to cracking shortly after exposure to traffic. As such, asphalt roads cannot be reinforced with steel rebar because as the asphalt cracks the rebar would become exposed, posing a driving hazard. Similarly, conventional concrete fillers cannot be used in asphalt because asphalt softens at comparatively high temperature of surrounding area. Separate fibers will simply be pulled out from the asphalt mass. While providing some beneficial effect, the use of filler material in asphalt is less than the effect provided in other concrete structures.

However, use of the ringed fiber structures described herein will strengthen the concrete and prevent cracks from spreading, without posing a driving hazard. In some embodiments, asphalt is reinforced using fiber rings, as described herein, formed from a composite fiber made from glass strengthening fibers and polyethylene binding fibers. These rings provide strength and rigidity, but allow for flexibility and have high affinity to the bituminous concrete. Such composition ring-fiber-structures can be considered either as small filler ring-fiber-structures and/or as structural rebar ring-fiber-structures to fix asphalt together. In some embodiments, these ringed fibers are used as filler material (e.g., not interlocked, or only inter-locked in small units, e.g., 2-10 rings). In some embodiments, the ringed fibers are interlocked to form a long lattice of rings.

In some embodiments, the ringed fiber structures provided herein are used to reinforce structures formed with pre-made building materials (e.g., bricks, cinder blocks, stone blocks, etc.) that are linked together to form a final structure (e.g., with cement or cement glue). In some embodiments, the fiber rings described herein are used as filler within the concrete. In other embodiments, the ringed fibers are inter-locked and threaded through the building materials (e.g., through holes, grooves, or cavities within the pre-formed building material), reinforcing the entire structure.

Figure 9:
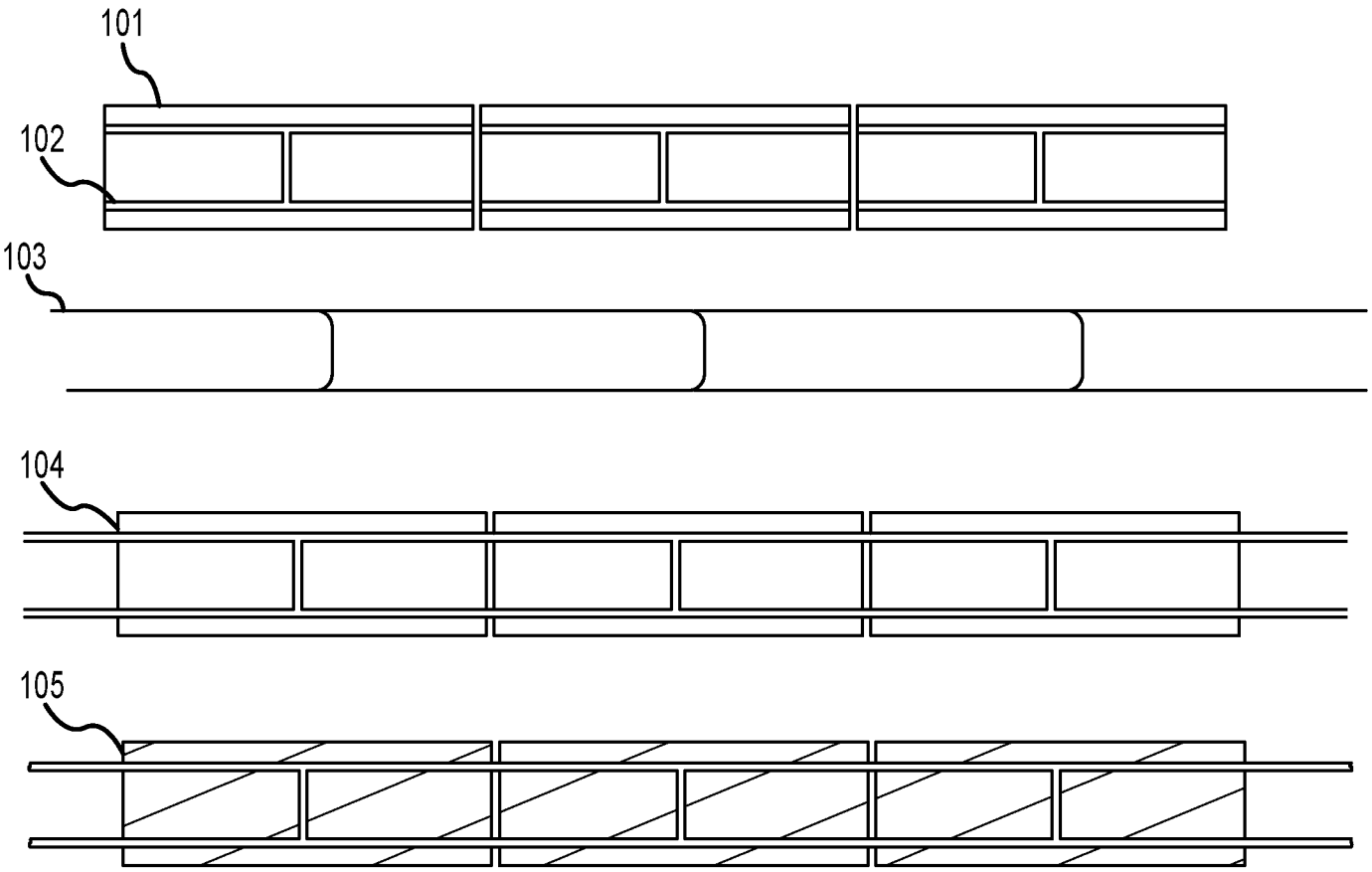
FIG. 9 illustrates another linear configuration of inter-locking fiber rings for use as a reinforcing agent in a structure, according to some implementation.

For example, referring to FIG. 9, premade building blocks 101 contain a groove or cavity 102 through which a plurality of inter-locking ringed fibers 103 (as described herein) is threaded to form an intermediate structure 104 of the building blocks 101 supported by the chain of ringed fibers 103. Blocks in the intermediate structure are then fixed together by an adhesive agent (e.g., cement, cement glue, epoxy resin, etc.) to form structure 105. Although shown in a horizontal structure in FIG. 9, structures may also be reinforced vertically or both horizontally and vertically using the ringed fiber reinforcements described herein.

In other embodiments, the ringed-fiber structures described herein can be used to reinforce structures formed by other building materials, e.g., gypsum (used in plasterboard), clay (used to form bricks), and wood-particle board (e.g., small ringed fibers can be mixed with wood-particles and fixed with resin).

Exemplary Embodiments.

In one aspect, the disclosure describes a method for making a reinforced concrete structure. The method includes obtaining a mold for the reinforced concrete structure; forming a lattice within the mold, where the lattice includes a plurality of inter-locking ringed fibers (e.g., as illustrated in FIGS. 2-8) and where each respective inter-locking ringed fiber in the plurality of inter-locking ringed fibers is a fiber formed into a ringed structure that is inter-locked with at least one neighboring inter-locking ringed fiber in the lattice. The method then includes filling the mold with concrete, thereby encasing the lattice. In some embodiments, the lattice is attached to one or more anchoring points within the mold (e.g., to the inside of the mold itself or to an object, such as a stake, placed within the mold) to elevate the lattice above the bottom of the mold. In this fashion, the lattice is encased more towards the middle of the concrete structure, rather than at the top of bottom of the structure.

In another aspect, the disclosure describes a reinforced concrete structure, including a lattice and concrete encasing the lattice. The lattice includes a plurality of inter-locking ringed fibers, and each respective inter-locking ringed fiber in the plurality of inter-locking ringed fibers comprises a fiber formed into a ringed structure that is inter-locked with at least one neighboring inter-locking ringed fiber in the lattice.

In some embodiments, the lattice includes a plurality of linear chains of the inter-locking ringed fibers (e.g., as illustrated in FIGS. 4, 5, 7, and 8).

In some embodiments, the lattice includes a plurality of branched chains of the inter-locking ringed fibers (e.g., as illustrated in FIG. 6), e.g., wherein at least one inter-locking ringed fiber in each chain of inter-locking ringed fibers is inter-locked with at least three neighboring inter-locking ringed fibers in the lattice.

In some embodiments, two or more of the branched chains of the inter-locking ringed fibers are inter-locked together.

In some embodiments, comparatively small separate ring fiber structures or two or more inter-locking ringed fiber structures are used as filler/additive for concrete mass.

In some embodiments, each respective inter-locking ringed fiber in the plurality of inter-locking ringed fibers is composed of one or more of a carbon fiber, a glass fiber, an aramid fiber, a metal fiber, a metal alloy fiber, and a nylon fiber.

In some embodiments, each respective inter-locking ringed fiber in the plurality of inter-locking ringed fibers is a composed of a composite of a glass fiber and a carbon fiber.

In some embodiments, the mold for the reinforced concrete structure is a frame for a roadway, and forming the lattice within the mold includes laying out (e.g., laying out, rolling out, unfolding, etc.) a pre-formed lattice of cross-linked chains of the inter-locking ringed fibers within the frame for the roadway (e.g., where the pre-formed lattice of cross-linked chains of the inter-locking ringed fibers has a width that is equal to or less than a width of the roadway).

In one aspect, the disclosure describes a reinforcement agent for concrete structures, comprising a plurality of ringed fibers, where each respective ringed fiber in the plurality of ringed fibers comprises a fiber formed into a ringed structure. In some embodiments, the ringed fibers are not interlocked. In this fashion, they are used to supplement or replace a conventional concrete filling material.

In some embodiments, the plurality of ringed fibers is a plurality of inter-locking ringed fibers and wherein each respective inter-locking ringed fiber in the plurality of inter-locking ringed fibers comprises a fiber formed into a ringed structure that is inter-locked with at least one neighboring inter-locking ringed fiber.

In some embodiments, each ringed fiber in the plurality of ringed fibers consists of a plurality of ringed fibers bound together by a binding agent.

In one aspect, the disclosure describes a reinforcement agent for building materials, comprising a plurality of ringed fibers, wherein each respective ringed fiber in the plurality of ringed fibers comprises a fiber formed into a ringed structure.

In some embodiments, the plurality of ringed fibers is a plurality of inter-locking ringed fibers and wherein each respective inter-locking ringed fiber in the plurality of inter-locking ringed fibers comprises a fiber formed into a ringed structure that is inter-locked with at least one neighboring inter-locking ringed fiber.

In some embodiments, each ringed fiber in the plurality of ringed fibers consists of a plurality of ringed fibers bound together by a binding agent.

In some embodiments, the building agent being reinforced is one or more of a concrete, an asphalt, a brick, a building block, a building stone, a gypsum, a clay, and a wood-particle material.

CONCLUDING REMARKS

It will be understood that, although the terms "first," "second," etc. may be used herein to describe various elements, these elements should not be limited by these terms. These terms are only used to distinguish one element from another. For example, a first object could be termed a second object, and, similarly, a second object could be termed a first object, without changing the meaning of the description, so long as all occurrences of the "first object" are renamed consistently and all occurrences of the "second object" are renamed consistently. The first object and the second object are both objects, but they are not the same object.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

The foregoing description included exemplary systems, methods, and apparatuses that embody illustrative implementations. For purposes of explanation, numerous specific details were set forth in order to provide an understanding of various implementations of the inventive subject matter. It will be evident, however, to those skilled in the art that implementations of the inventive subject matter may be practiced without these specific details.

The foregoing description, for purpose of explanation, has been described with reference to specific implementations. However, the illustrative discussions above are not intended to be exhaustive or to limit the implementations to the precise forms disclosed. Many modifications and variations are possible in view of the above teachings. The implementations were chosen and described in order to best explain the principles and their practical applications, to thereby enable others skilled in the art to best utilize the implementations and various implementations with various modifications as are suited to the particular use contemplated.

What is claimed is:

1. A reinforced building structure, comprising:

a lattice comprising a first inter-locking assembly and a second inter-locking assembly, wherein the first inter-locking assembly comprises a first plurality of ring shaped fibers, wherein the second inter-locking assembly comprises a second plurality of ring shaped fibers, and wherein a first ring of the first plurality of ring shaped fibers is folded over a second ring of the second plurality of ring shaped fibers; and a building agent encasing the lattice.

2. The reinforced building structure of claim 1, wherein the first plurality of ring shaped fibers is a linear chain of ring shaped fibers.

3. The reinforced building structure of claim 1, wherein the first plurality of ring shaped fibers is a branched chain of ring shaped fibers.

4. The reinforced building structure of claim 3, wherein the first plurality of ring shaped fibers is a linear chain of ringed fibers and the second plurality of ring shaped fibers is a branched chain of ringed fibers.

5. The reinforced building structure of claim 1, wherein the first plurality of fibers is composed of one or more of a carbon fiber, a glass fiber, an aramid fiber, a metal fiber, a metal alloy fiber, and a nylon fiber.

6. The reinforced building structure of claim 1, wherein the first plurality of fibers is composed of two or more of a carbon fiber, a glass fiber, an aramid fiber, a metal fiber, a metal alloy fiber, and a nylon fiber.

7. The reinforced building structure of claim 1, wherein the first plurality of ring shaped fibers includes a glass fiber and a carbon fiber.

8. The reinforced building structure of claim 1, wherein the first plurality of ring shaped fibers includes a composite of a mineral fiber and a carbon fiber.

9. The reinforced building structure of claim 1, wherein the first inter-locking assembly is a liner chain.

10. The reinforced building structure of claim 1, wherein the first inter-locking assembly is a branched chain.

11. The reinforced building structure of claim 1, wherein the first inter-locking assembly is a liner chain and the second inter-locking assembly is a branched chain.

* * * * *